US006055992A

United States Patent [19]

Skarne

[11] Patent Number: 6,055,992

[45] Date of Patent: May 2, 2000

[54] SHATTERPROOF COSMETIC COMPACT

[76] Inventor: Jenny Skarne, 20 Chapel St., Apt. 511, Brookline, Mass. 02146

[21] Appl. No.: 09/314,500

[22] Filed: May 19, 1999

[51] Int. Cl.[7] ..... A45D 33/00

[52] U.S. Cl. ..... 132/293; 132/294; 132/315; 206/581

[58] Field of Search ..... 132/293, 298, 132/301, 303, 304, 305, 299; 206/235, 823, 581; 220/324, 326, 344

[56] References Cited

U.S. PATENT DOCUMENTS

| | | | |
|---|---|---|---|
| 1,512,005 | 10/1924 | Wright | 132/293 |
| 2,315,647 | 4/1943 | Nyden | 132/293 |
| 2,362,120 | 11/1944 | De Swart | 132/301 |
| 2,424,817 | 7/1947 | Grassi | 132/293 |
| 3,442,414 | 5/1969 | Pelli | 132/301 |
| 4,333,128 | 6/1982 | Moore | 362/135 |
| 5,896,866 | 4/1999 | Quennessen | 132/293 |
| 5,908,037 | 6/1999 | Pierson | 132/293 |

*Primary Examiner*—Gene Mancene
*Assistant Examiner*—Pedro Philogene
*Attorney, Agent, or Firm*—Morse & Altman

[57] ABSTRACT

A cosmetic compact has a housing that is composed of an elastomeric foam. The housing may be hermetically sealed or opened easily by virtue of a tongue and groove structure. An array of cosmetics is easily accessible and replaceable by virtue of the hierarchy of dimensional stability of its components, by which the array is sufficiently compliant to permit its covers to have living hinges, but sufficiently rigid to permit it to be snapped as a whole into the shallow dish provided for it by the housing. Different arrays may be supplied together with a particular housing-mirror combination or may be supplied later for replacement.

6 Claims, 1 Drawing Sheet

SHATTERPROOF COSMETIC COMPACT

BACKGROUND OF THE INVENTION

1. Field of the Invention

The present invention relates to compacts for cosmetics and, more particularly, to cosmetic compacts of the type containing a mirror and at least one compartment for carrying cosmetic make-up and the like.

2. The Prior Art

A variety of cosmetic compact structures have been proposed. Sometimes these structures suffer from being fragile, non-hermetic, complex, unsanitary and/or confining. Sometimes, such structures even may be dangerous, as when a glass mirror therein breaks or cracks. Furthermore, a mechanical impact may rupture expensive contents, such as costly powders or pharmaceuticals. There is a need for a cosmetic compact that obviates all of these prior deficiencies, i.e. that is shatterproof, protective, hermetic, simple, sanitary and expansive, as well as attractive and versatile.

SUMMARY OF THE INVENTION

The object of the present invention is to provide a cosmetic compact comprising a generally flat housing, a generally coextensive mirror and a generally coextensive cosmetic compartment, which are characterized by particular structural and interacting features. The housing is composed of an integral elastomer and has two flaps that are hinged at an anchor region and are provided throughout the remainder of their peripheries with an elongated tongue and an elongated groove. The tongue and groove mate on being manually squeezed, incrementally and serially, to provide a hermetic seal about the entire housing. This seal protects the interior against leakage from the environment, and protects the environment against leakage from the interior. The mirror is a dimensionally sturdy plate of clear glass or plastic, one face of which has been aluminized. The cosmetic compartment is a dimensionally sturdy case that is easily removed and replaced. One flap of the housing is provided with an interior peripheral lip into which the mirror snaps and by which the mirror is securely cushioned and retained. The other flap of the housing is provided with an interior lip into which the cosmetic compartment snaps and by which the cosmetic compartment is securely cushioned and retained. Preferably, the housing is composed of an elastomeric foam. The arrangement is such that the compact is designed to have a dimensionally stable shatterproof and shockproof configuration that protects itself, as well as its contents.

Other objects of the present invention will in part be obvious and will in part appear hereinafter.

BRIEF DESCRIPTION OF THE DRAWINGS

For a fuller understanding of the nature and object of the present invention, reference is made to the following specification which is to be taken in connection with the accompanying drawings, wherein.

DETAILED DESCRIPTION OF THE PREFERRED EMBODIMENT

Figure 1:
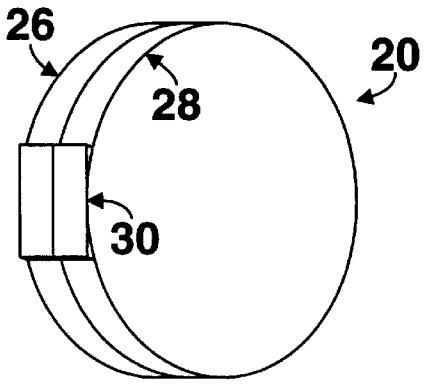
FIG. 1 is a perspective view of a preferred embodiment of the cosmetic compact of the present invention, in closed condition.
Figure 2:
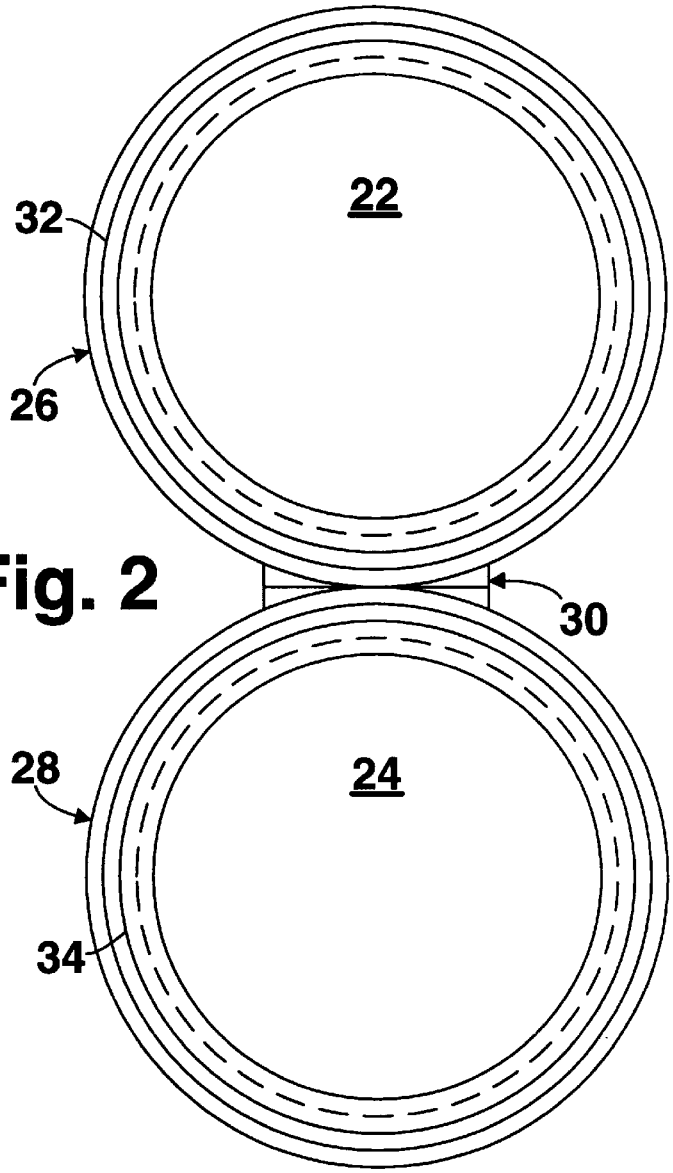
FIG. 2 is a plan view of the cosmetic compact of FIG. 1, in open condition.
Figure 3:
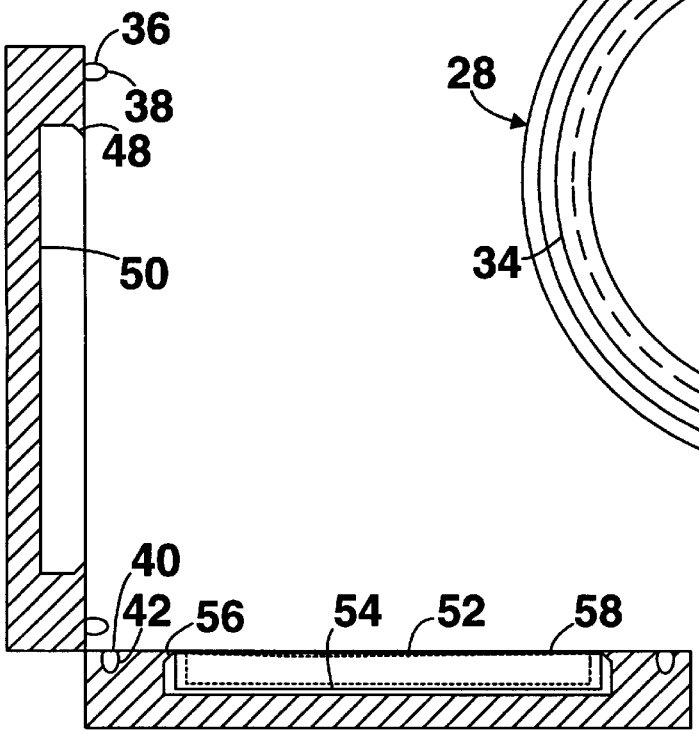
FIG. 3 is a cross-sectional view of the compact of FIG. 1, when in partially open condition, along a plane through the geometrical centers of the flaps.

The illustrated cosmetic compact is generally planar and comprises an outer flexible and compliant plastic housing 20, an inner dimensionally sturdy mirror 22, and an inner dimensionally sturdy cosmetic compartment 24 that, for example, contains make-up powder. The housing, the mirror and the cosmetic compartment, preferably, are of substantially the same planar extent (except for the thickness of the edge of the housing). Preferably, the plastic or rubber of which the housing is composed is an elastomeric foam, particularly, a polyurethane or rubber foam. Preferably, the exterior surface of the housing has a matte surface.

The mirror is composed of a clear glass or polymer, of which the undersurface is aluminized and that is sufficiently thick, i.e. at least three-sixteenths inch thick, to prevent cracking when subjected to ordinary bending stress. Preferably, compartment 24, which is a make-up container, is composed of a rigid plastic or metal.

The housing has two coextensive flaps 26, 28 for holding the mirror and the cosmetic compartment, respectively. These flaps are hinged integrally at an anchor region 30 and are provided throughout their peripheries with an elongated tongue 32 and an elongated groove 34. The tongue and groove are annular and mate on being incrementally and sequentially compressed manually, in other words, by being drawn by one hand between the pinched fingers of the other hand.

In cross-section, the tongue and groove are characterized by matched profiles. The tongue has a relatively narrow exterior neck profile 36 and a relatively wide exterior head profile 38. The groove has a relatively narrow interior neck profile 40 and a relatively wide interior head profile 42. When mated, the tongue and groove constitute a virtual hermetic seal that protects the contents of the compact from the environment and the environment from the contents of the compact. The edges of flaps 26, 28 may be engaged by the fingers to peel apart the flaps when mated in order to enable access to the contents of the housing.

The interior of flap 26 has a shallow dish profile 50. In proximity to the elongated tongue of flap 26 is an inwardly positioned and directed lip 48. As above stated, lip 48 is integrally composed by the same elastomeric material as is the remainder of the housing. Mirror 22, which is coextensive with the region 50 beneath lip 48, once forced past the lip into region 50, is retained snugly in position by lip 48. The interior of flap 28 has a shallow dish profile 54. In proximity to the elongated groove of flap 28 is an inwardly positioned and directed lip 56. As above stated, lip 56 is integrally composed by the same elastomeric material as is the remainder of the housing. Compartment 24, which is coextensive with the region 50 beneath lip 56, once forced past the lip into region 54, is retained snugly in position by lip 56. The arrangement is such that mirror 22 and compartment 24, when installed, are recessed into regions 50 and 54, respectively, and thereby are protected by lips 48 and 56, respectively, if the compact is accidentally dropped while open.

Compartment 24 is a shallow dish having an outer opening 52 and a cover 58 that is hinged to the opening at one diametric extremity and retained by a catch at the opposite diametric extremity. The arrangement is such that compartment 24 may be sold initially and/or replaced thereafter in different formats and/or with different contents for assembly with the remainder of the housing.

Operation

In operation, the cosmetic compact of the present invention may be of any reasonable size. The configuration of its outer flexible elastomeric housing is maintained by its mirror and may be hermetically sealed or opened easily by virtue of its tongue and groove structure. At the same time, its cosmetic compartment is easily accessible and replaceable by virtue of the elastomeric lips that retain it. Different arrays may be supplied together with a particular housing-mirror combination or may be supplied later for replacement. The construction thus may be designed for different complexions and medicinal needs. The arrangement is such that the compact is designed to have a dimensionally stable configuration that is extremely versatile and efficacious.

What is claimed is:

1. A cosmetic compact comprising:

a generally flat housing, a generally coextensive mirror and a generally coextensive cosmetic container;

said housing being composed of a member of the class consisting of compliant plastics and rubbers;

said housing having two flaps that are hinged at an anchor region;

one of said flaps having an elongated tongue at the remainder of its periphery;

the other of said flaps having an elongated groove at the remainder of its periphery;

said tongue and groove mating on being manually squeezed, incrementally and serially, to provide a hermetic seal about said housing;

said mirror being a clear plate, one face of which has been aluminized;

said cosmetic container having a compartment and a lid that are joined by a hinge, said lid being pivotable between an open condition in which the contents of said compartment are accessible, and a closed condition in which the contents of said compartment are sealed;

one flap of said housing being provided with an interior peripheral lip into which said mirror snaps and by which the mirror is securely cushioned and retained;

the other flap of said housing being provided with an interior peripheral lip into which said cosmetic container snaps and by which said cosmetic container is securely cushioned and retained.

2. The cosmetic compact of claim 1, wherein said tongue and groove are characterized by matched profiles, said tongue having a relatively narrow exterior neck profile and a relatively wide exterior head profile, and said groove having a relatively narrow interior neck profile and a relatively wide interior head profile, said flaps being composed of an elastomeric foam.

3. A cosmetic compact comprising:

(a) generally flat housing, (b) said housing being composed of an elastomeric foam;

(c) said housing having two flaps that arc hinged at an anchor region;

(d) each of said flaps having a receptacle region;

(e) a mirror retained in the receptacle region of one of said flaps; and (f) at least one cosmetic container retained in the receptacle region of the other of said flaps.

4. A cosmetic compact comprising:

a generally flat housing, a generally coextensive mirror, and a generally coextensive compartment;

said housing being composed of an integral elastomeric foam;

said housing having two flaps that are hinged at an anchor region;

one of said flaps having an elongated tongue throughout its periphery;

the other of said flaps having an elongated groove throughout its periphery;

said tongue and groove mating on being manually squeezed, incrementally and serially, to provide a hermetic seal about said housing;

each of said flaps providing a shallow dish having an integral elastomeric lip that projects inwardly;

said mirror being a clear plate, one face of which has been aluminized;

said mirror being removably retained in said shallow dish of one of said flaps by the lip thereof;

said compartment being removably retained in said shallow dish of the other of said flaps by the lip thereof;

said tongue and groove being characterized by matched profiles, said tongue having a relatively narrow exterior neck profile and a relatively wide exterior head profile, and said groove having a relatively narrow interior neck profile and a relatively wide interior head profile;

said compartment being readily replaceable.

5. A cosmetic compact:

(a) said cosmetic compact, when closed, having substantially parallel, substantially planar faces;

(b) said cosmetic compact comprising an outer flexible and compliant plastic housing, an inner dimensionally sturdy mirror, and an inner dimensionally sturdy compartment for containing cosmetics;

(c) said housing, said mirror and said compartment being of substantially the same planar extent except for the thickness of the edge of said housing;

(d) said housing being composed of an elastomeric foam, the exterior surface of said housing having a matte surface;

(e) said mirror being composed of a clear plate, of which the undersurface is aluminized;

(f) said mirror being sufficiently thick to prevent cracking when subjected to ordinary bending stress;

(g) said compartment being composed of a rigid material;

(h) said housing having two coextensive flaps for holding said mirror and said compartment, respectively;

(i) said flaps being hinged integrally at an anchor region;

(j) said flaps being provided substantially throughout their peripheries with mating configurations;

(k) said mating configurations constituting a seal on being incrementally and sequentially compressed manually;

(l) in cross-section, said mating configurations being characterized by matched profiles;

(m) one of said matched profiles being presented integrally by one of said flaps;

(n) the other of said matched profiles being presented by the other of said flaps;

(o) said seal protecting the contents of said housing from the environment and the environment from the contents of said housing;

(p) a pair of an inwardly positioned and directed lips;

(q) one of said lips being in proximity to one of said mating configurations;

(r) the other of said lips being in proximity to the other of said mating configurations;

(s) said mirror being retained snugly and removably by one of said lips in one of said flaps;

(t) said compartment being retained snugly and removably by one of said lips in one of said flaps;

(u) said lips being integrally composed of the same elastomeric foam as the remainder of said housing;

(v) said flaps being provided with superposed means that are adapted to be engaged by the fingers to peel apart said flaps when mated in order to enable access to the contents of said housing.

6. The cosmetic compact of claim 5, wherein:

(a) said configurations include an elongated tongue and an elongated groove;

(b) said tongue and groove mating on being incrementally and sequentially compressed manually;

(c) in cross-section, said tongue and groove being characterized by matched profiles;

(d) said tongue having a relatively narrow exterior neck profile and a relatively wide exterior head profile; and (e) said groove having a relatively narrow interior neck profile and a relatively wide interior head profile.

* * * * *